US006705808B2

(12) United States Patent
Kane

(10) Patent No.: US 6,705,808 B2
(45) Date of Patent: Mar. 16, 2004

(54) BIG GAME TRACKING ARROW AND APPARATUS FOR THE MANUFACTURE THEREOF

(76) Inventor: William R. Kane, 4873 Hardt Rd., Gibsonia, PA (US) 15044

( * ) Notice: Subject to any disclaimer, the term of this patent is extended or adjusted under 35 U.S.C. 154(b) by 0 days.

(21) Appl. No.: 10/317,704

(22) Filed: Dec. 12, 2002

(65) Prior Publication Data

US 2003/0083159 A1 May 1, 2003

Related U.S. Application Data

(63) Continuation of application No. 09/874,620, filed on Jun. 5, 2001, now abandoned.

(51) Int. Cl.[7] ..... B23B 49/02

(52) U.S. Cl. ..... 408/72 B; 408/115 R; 408/115 B

(58) Field of Search ..... 408/72 B, 103, 408/115 R, 115 B, 97, 241 B, 72 R

(56) References Cited

U.S. PATENT DOCUMENTS

| | | | | | |
|---|---|---|---|---|---|
| 190,042 | A | * | 4/1877 | Hurd | 408/97 |
| 2,353,757 | A | * | 7/1944 | Priest, Jr. | 408/241 R |
| 2,363,085 | A | * | 11/1944 | Roye | 408/72 R |
| 2,369,869 | A | * | 2/1945 | Testo | 408/67 |
| 2,415,267 | A | * | 2/1947 | Vaughn | 408/97 |
| 2,554,012 | A | | 5/1951 | Cohen | |
| 2,753,740 | A | * | 7/1956 | Marx | 408/72 R |
| 2,913,933 | A | * | 11/1959 | Bosse | 408/8 |
| 2,976,748 | A | * | 3/1961 | Quick et al. | 408/97 |
| 3,393,912 | A | | 7/1968 | DeLonais | |
| 3,404,897 | A | * | 10/1968 | Carter, Jr. et al. | 279/50 |
| 3,617,060 | A | | 11/1971 | Iezzi | |
| 3,743,433 | A | * | 7/1973 | Smith | 408/97 |
| 4,212,463 | A | | 7/1980 | Repinski et al. | |
| 4,277,069 | A | | 7/1981 | Rouse | |
| 4,712,950 | A | * | 12/1987 | Reynolds | 408/72 R |
| 6,238,310 | B1 | | 5/2001 | Morrison | |

* cited by examiner

*Primary Examiner*—Daniel W. Howell
(74) *Attorney, Agent, or Firm*—Buchanan Ingersoll, P.C.

(57) ABSTRACT

An arrow, according to the preset invention, is provided for improved big game tracking. The arrow includes an elongate shaft formed along a longitudinal axis and having a first end configured for attachment to an arrowhead, a second end having an arrow nock or other structure configured for abutment with a bow string, and a tubular wall defining a shaft cavity extending between the first and second ends. The elongate shaft includes at least one aperture formed in the tubular wall generally adjacent in the first end and in fluid communication with the shaft cavity. The elongate shaft further includes an additional at least one aperture formed in the tubular wall generally adjacent the second end also and in fluid communication with the shaft cavity. Typically, the elongate shaft has a cylindrical cross-section, with fletching attached to the elongate shaft generally adjacent the second end.

20 Claims, 4 Drawing Sheets

BIG GAME TRACKING ARROW AND APPARATUS FOR THE MANUFACTURE THEREOF

"This application is a divisional of U.S. application Ser. No. 09/874,620, filed Jun. 5, 2001, now abandoned."

FIELD OF THE INVENTION

The present invention is directed generally toward arrows and, more particularly, toward an arrow for improved big game tracking and an apparatus for modifying a standard arrow for improved big game tracking.

BACKGROUND OF THE INVENTION

The hunting of big game, e.g., deer, elk, etc., with bows and arrows is becoming a popular activity in the United States. In fact, many states have special archery seasons during which hunting with a firearm is prohibited. While state of the art bows and arrows have made the average bow hunter more proficient in inflicting a fatal wound, harvesting big game, such as deer, elk, etc., with a bow and arrow is still less efficient than with a firearm. For example, deer hit with a shot to the vital region with an arrow may still run a considerable distance out of the eyesight of the hunter before deceasing. A problem that often arises with bow hunting concerns the tracking and locating of a wounded or "hit" animal for harvesting.

As previously noted, once a big game animal is hit by an arrow, it may run a considerable distance prior to deceasing. A hunter desiring to harvest the animal is thus required to track the animal, typically by following a trail of blood on the ground left by the running animal. At times, such a trial may become sparse and difficult to follow, and may merely consist of a drop of a blood every so many feet or yards. While a hunter hunting with snow on the ground may follow the tracks of the animal should the blood trail run dry, tracking an animal in this manner often proves extremely difficult when there is no snow on the ground. Even with snow on the ground, such tracking is difficult as tracks from other animals are typically dispersed over the ground surface.

A blood trail may run dry for a number of reasons. When hunting big game animals, such as deer, elk, etc., the arrowhead typically includes a broad head having a plurality of razor-sharp blades extending normal to the arrow shaft and head. These razor-sharp blades slice through the animal's skin upon impact. Big game animals typically have thick skins, or hides, which is the reason the razor-sharp blades are utilized. Upon an arrow becoming lodged in an animal which is hit, the animal hide and/or muscle or fatty type tissue typically located on the inside surface of the hide may close up around the arrow shaft. Such closure will often times prohibit blood from flowing out of the animal and on to the ground so that the wounded animal may be tracked by a hunter. While the animal will continue to bleed internally, no blood will flow to the ground for tracking purposes. Thus, even though an animal may be mortally wounded, a hunter will typically be unable to track and find the deceased animal, especially should the animal travel a considerable distance before decreasing. This may prove extremely disheartening to a hunter, and especially to a deer hunter when a trophy rack is lost due to the blood trail running dry. While a hunter returning to the area may ultimately find the deceased animal, this may not be until a day or two later during which time any meat that may be taken from the animal may spoil.

The present invention is directed toward overcoming one or more of the above-identified problems.

SUMMARY OF THE INVENTION

An arrow, according to the preset invention, is provided for improved big game tracking. The arrow includes an elongate shaft formed along a longitudinal axis and having a first end configured for attachment to an arrowhead, a second end having an arrow nock or other structure configured for abutment with a bow string, and a tubular wall defining a shaft cavity extending between the first and second ends. The elongate shaft includes at least one aperture formed in the tubular wall generally adjacent in the first end and in fluid communication with the shaft cavity. The elongate shaft further includes an additional at least one aperture formed in the tubular wall generally adjacent the second end also and in fluid communication with the shaft cavity. Typically, the elongate shaft has a cylindrical cross-section, with fletching attached to the elongate shaft generally adjacent the second end.

The at least one aperture formed in the tubular wall generally adjacent the first end preferably includes a first plurality of apertures and, similarly, the at least one aperture formed in the tubular wall generally adjacent the second end preferably includes a second plurality of apertures. At least one of the first and second plurality of apertures preferably includes two, three or four radially extending apertures equally angularly spaced about the longitudinal axis of the elongate shaft.

In one form of the present invention, at least one of the first and second plurality of the apertures includes first and second portions of radially extending apertures axially spaced along the longitudinal axis of the elongate shaft, with the first portion of radially extending apertures angularly spaced from the second portion of radially extending apertures. In a further form of the present invention, each of the first portion of radially extending apertures is axially and angularly spaced from each of the second portion of radially extending apertures.

An arrowhead, according to the present invention, is also provided for attachment to an arrow. The arrow typically includes a longitudinal aperture formed in the shaft first end and in fluid communication with the shaft cavity. The arrowhead generally includes an elongate body having a first end configured for attachment to an arrow, a second end defining a pointed end, and a cylindrical wall defining a body cavity between the first and second ends. The elongate body includes at least one aperture formed in the cylindrical wall in fluid communication with the body cavity. An aperture is formed, in the elongate body first end in fluid communication with the body cavity to permit fluid communication with the shaft cavity of the arrow elongate shaft and the body cavity of the arrowhead with the first end of the arrowhead attached to the first end of the arrow elongate shaft.

The elongate body of the arrowhead is typically configured for attachment to a plurality of razor-sharp blade elements extending substantially normal to the elongate body. The at least one aperture may include a plurality of radially extending apertures formed in the cylindrical wall of the elongate body between the razor-sharp blade elements.

An apparatus, according to the present invention, is provided for modifying an arrow for improved big game tracking. The apparatus includes a jig member having a body portion with spaced first and second ends and a longitudinal axis. The body portion includes an outer surface and inner surface, with the inner surface defining a first aperture extending through the body portion along the longitudinal axis. The first aperture is sized to receive a shaft of an arrow. The body portion further includes at least one second aperture extending through the body portion from the inner surface to the outer surface. In a preferred form, the at least one second aperture includes a radially extending aperture having a diameter ranging from 1/32" to 5/32" and, preferably, having a diameter of 1/16".

The at least one radially extending second aperture preferably includes a plurality of radially extending apertures. In one form, the plurality of radially extending apertures includes 2, 3, or 4 radially extending apertures equally angularly spaced about the longitudinal axis of the body portion.

In another form, the plurality of radially extending apertures includes first and second portions of radially extending apertures axially spaced along the longitudinal axis of the body portion, with the first portion of radially extending apertures angularly spaced from the second portion of radially extending apertures.

In a further form, the first and second portions of radially extending apertures are coaxial. In still a further form, each of the first portion of radially extending apertures is axially and angularly spaced from each of the second portion of radially extending apertures.

The jig member preferably includes a securing member disposed generally proximate at least one of the first and second ends. The securing member is configured to engage an arrow shaft, extending through the first aperture to releasably secure the jig member to the arrow shaft, and also to center the arrow shaft within the first aperture. Preferably, the securing member included a plurality of set screws extendable through radially extending threaded apertures formed through the body portion from the inner surface to the outer surface.

In an additional form, the jig member includes a plurality of longitudinal slots formed in the body portion between the inner and outer surfaces. The plurality of longitudinal slots include an open end at the body portion first end and extend generally longitudinally along the body portion. The plurality of longitudinal slots are preferably equally angularly spaced about the body portion longitudinal axis. Typically, the jig member will include three or four equally angularly spaced longitudinal slots.

An apparatus, according to the present invention, is provided for modifying an arrowhead for improved big game tracking. The apparatus includes a jig member having a body portion with spaced first and second ends, and a step bore extending into the body portion along a central axis. The step bore include an innermost bore having a first diameter and an outermost bore opening at the first end and having a second diameter greater than the first diameter. At least one aperture extends through the body portion of the jig member and opens into the step bore at the outermost bore. Preferably, the at least one aperture is a radially extending aperture.

In one form, the at least one radially extending aperture includes a plurality of radially extending apertures equally angularly spaced about the central axis. Typically, the plurality of radially extending apertures will include 2, 3, or 4 radially extending apertures equally angularly spaced about the central axis, depending upon on the type of arrowhead to be modified. For securing the arrowhead in the step bore, the innermost bore typically includes a threaded inner surface for mating with threads typically included on an end of an arrowhead.

It is the object of the present invention to provide an arrow for improved big game tracking.

It is another object of the present invention to provide an arrow for improved big game tracking which lessens the chance that a blood trail may dry up.

It is a further object of the present invention to provide an arrowhead for improved big game tracking.

It is yet a further object of the present invention to provide an apparatus for modifying an arrow for improved big game tracking.

It is still a further object of the present invention to provide an apparatus for modifying an arrowhead for improved big game tracking.

Other aspects, objects and advantages of the present invention can be obtained from a study of the application, the drawings, and the appended claims.

DETAILED DESCRIPTION OF THE INVENTION

Figure 1:
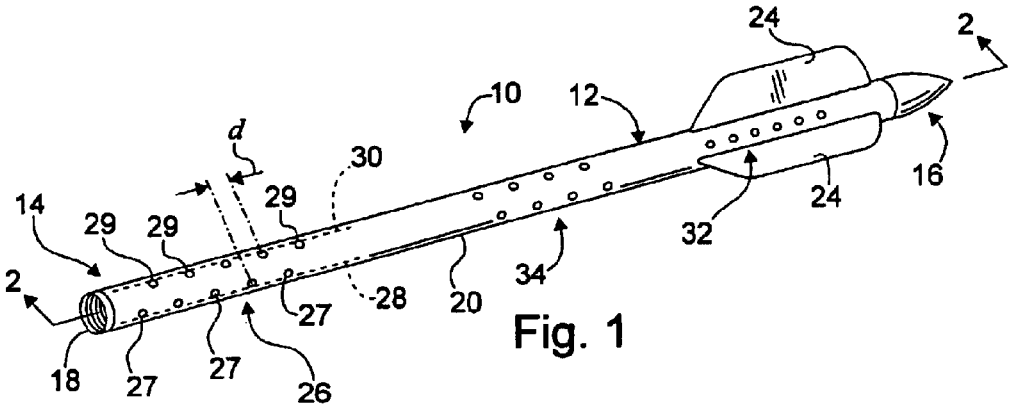
FIG. 1 is a perspective view of an arrow according to the present invention.
Figure 2:
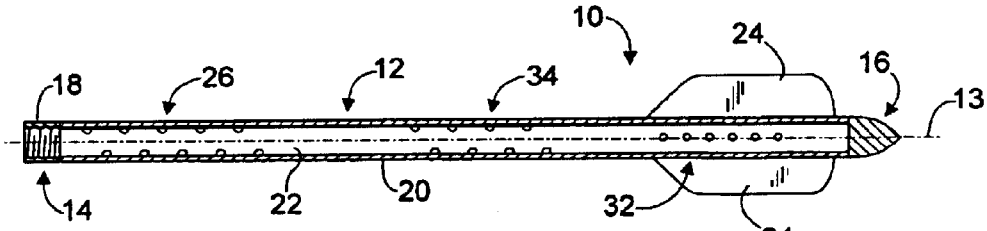
FIG. 2 is a cross-sectional view of the arrow of FIG. 1 taken along line 2—2 in FIG. 1.
Figure 5:
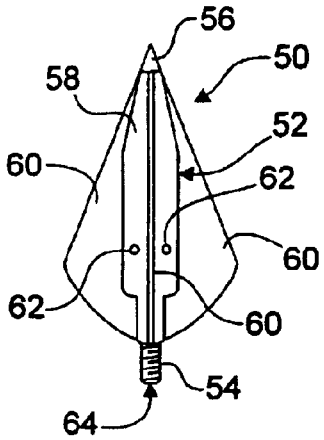
FIG. 5 is a front view of an arrowhead according to the present invention.

Referring to FIGS. 1 and 2, an arrow for improved big game tracking according to the present invention is shown generally at 10. The arrow 10 includes an elongate shaft formed along a longitudinal axis 13 and 12 having first 14 and second 16 ends. The first end 14 is configured for attachment to an arrowhead (see FIG. 5) and typically includes an internal threaded portion 18. The second end 16 is configured for attachment to a conventional arrow nock (not shown) or other structure for abutment with a bow string (not shown). The elongate shaft 12 further includes a tubular wall 20, which defines a shaft cavity 22 extending between the first 14 and second 16 ends. Fletching 24 is typically affixed to the elongate shaft 12 generally adjacent the second end 16. Generally, the arrow 10 will be made of aluminum, fiberglass or carbon fibers, however, any material having sufficient strength and rigidity may be used for the arrow 10 without departing from the spirit and scope of the present invention.

A first plurality of apertures 26 are formed in the tubular wall 20 generally adjacent the first end 14 in fluid communication with the shaft cavity 22. The first plurality of apertures 26 includes a first portion of apertures 27 axially spaced along a first line 28 substantially parallel with the longitudinal axis 13, and a second portion of apertures 29 axially spaced along a second line 30 substantially parallel with the longitudinal axis 13. The first portion of apertures 27 is angularly spaced from the second portion of apertures 29 about the longitudinal axis 13. Additionally, each of the first portion of apertures 27 is axially spaced a distance "d" from each of the second portion of apertures 29. Preferably, the distance "d" ranges from 0.5" to 1.0". In this manner, the structural integrity of the arrow 10 is maintained.

Figure 3:
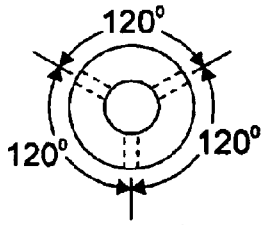
FIG. 3 is a left-end view of the arrow 10 shown in FIG. 1 incorporating three equally angularly displaced sets of apertures.
Figure 4:
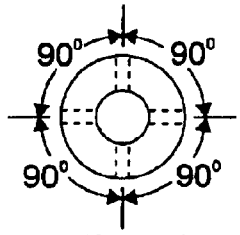
FIG. 4 is a left-end view of the arrow shown in FIG. 1 incorporating four equally angularly displaced sets of apertures.

Preferably, the first plurality of apertures 26 includes pluralies of axially spaced portions of apertures equally angularly spaced. For example, as shown in FIG. 3, if three portions of axially spaced apertures are provided, they will be angularly spaced 120° apart. Similarly, as shown in FIG. 4, if four portions of axially spaced apertures are provided, they will be angularly spaced 90° apart. When using two or three portions of axially spaced apertures, maintaining the structural integrity of the arrow 10 is not of particular concern. However, when using four portions of axially spaced apertures, it is preferred that each aperture in adjacent portions be axially spaced from one another, as shown in FIGS. 1 and 2.

The arrow 10 also includes a second plurality of apertures 32 formed in the tubular wall 20 generally adjacent the second end 16 in fluid communication with the shaft cavity 22. Each of the second plurality of apertures 32 are axially spaced along the longitudinal axis 13 and are typically provided between the fletchings 24. Thus, if three fletchings 24 are provided, the second plurality of apertures 32 will include three portions of axially spaced apertures between each of the fletchings 24. If four fletchings 24 are provided, the second plurality of apertures 32 will include four portions of axially spaced apertures between each of the fletchings 24. As previously noted, in order to maintain the structural integrity of the arrow 10, if the second plurality of apertures 32 includes four portions of axially spaced apertures, it is preferred that the apertures of adjacent portions be axially spaced the distance "d" from one another. Further, whether the second plurality of apertures 32 includes three or four portions of axially spaced apertures, the portions will typically be equally angularly spaced.

A third plurality of apertures 34 are also formed in the tubular wall 20 in fluid communication with the shaft cavity 22. The third plurality of apertures 34 are positioned along the length of the shaft 12 such that they are spaced from the first plurality of apertures 26. While the third plurality of apertures 34 are shown in FIGS. 1–2 positioned generally in the middle of the arrow 10, the third plurality of apertures 34 may be disposed at any position along the length of the shaft 12 spaced from the first plurality of apertures 26 without departing from the spirit and scope of the present invention. The third plurality of apertures 34 are axially spaced and angularly oriented in the same manner as previously described with respect to the first plurality of apertures 26.

The above-described arrow 10 has a distinct advantage for hunting big game. When the arrow 10 is lodged into a big game animal, the first end 14 and the first plurality of apertures 26 will be disposed inside of the animal, while the second end 16 and the second plurality of apertures 32, and perhaps the third plurality of apertures 34, will be outside of the animal. Blood from the animal will flow into the first plurality of apertures 26, through the shaft cavity 22, and out the second 32 and/or third 34 plurality of apertures falling to the ground and enabling a hunter to track the wounded or "hit" animal, Flow of blood in the manner will continue even if the hide of the animal closes around the elongate shaft 12 of the arrow 10. Further, even if the second end 16 of the arrow 10 is broken off, blood will still flow out of the shaft cavity 22 and onto the ground. Thus, by utilizing the above-described arrow 10, the chance that a blood trail will run dry is lessened, thus increasing the chance that a hunter will be able to track and eventually harvest an animal shot with the arrow 10. The first 26, second 32 and third 34 pluralities of apertures may include diameters ranging from 1/32" to 5/32", however, it has been found that optimum blood flow and arrow 10 integrity are achieved with apertures having a diameter of 1/16". If the apertures are too large, the arrow 10 will whistle and the structural integrity of the arrow 10 will be comprised. However, if the apertures are too small, the flow of blood through the apertures is impeded. Various aperture diameters have been tested, and a 1/16" aperture diameter has provided the best results.

Referring to FIGS. 5–8, an arrowhead for improved big game tracking according to the present invention is shown generally at 50. The arrowhead 50 includes an elongate body 52 having a first threaded end 54 configured for attachment to the arrow 10 and a second end 56 defining a pointed end. The elongate body 52 further includes a cylindrical wall 58 defining a body cavity between the first 54 and second 56 ends. A plurality of razor-sharp blades 60 are attachable to the elongate body 52 and extend substantially normal to the elongate body 52. A plurality of apertures 62 are formed in the cylindrical wall 58 extending into, and in fluid communication with, the body cavity. Preferably, the apertures 62 extend radially into the cylindrical wall 58. The first end 54 includes a longitudinally extending aperture 64 formed therein and also in fluid communication with the body cavity. While it is preferred that the apertures 62 and 64 have diameters approximately equal to 1/16", other aperture diameters may be utilized without departing from the spirit and scope of the present invention.

When utilized with the arrow 10 shown and described with respect to FIGS. 1–4, the arrowhead 50 aids in improving big game tracking. With the arrowhead 50 lodged in an animal, blood from the animal will flow into the apertures 62, through the arrowhead body cavity, and out the longitudinal aperture 64. Blood flowing our of the longitudinal aperture 64 flows into the shaft cavity 22 of the arrow 10, and out the second 32 and/or the third 34 plurality of apertures and onto the ground for tracking purposes.

Figure 6:
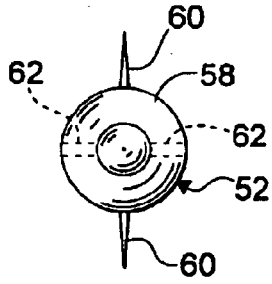
FIG. 6 is a top view of the arrowhead shown in FIG. 5 incorporating two blade elements.
Figure 7:
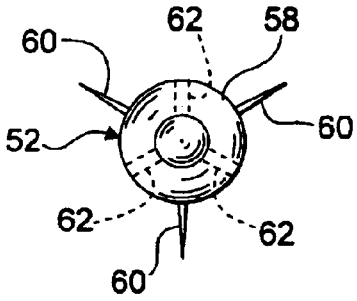
FIG. 7 is a top view of the arrowhead shown in FIG. 5 incorporating three blade elements.
Figure 8:
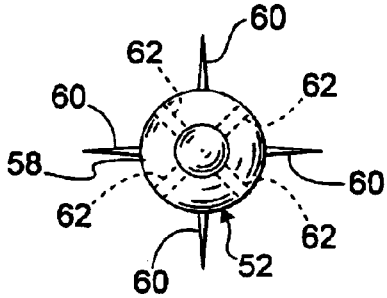
FIG. 8 is a top view of the arrowhead shown in FIG. 5 incorporating four blade elements.

Preferably, the apertures 62 are equally angularly spaced and provided between the blade elements 60. Thus, as shown in FIG. 6, if the arrowhead 50 includes two blade elements 60 the apertures 62 are formed on either side of the elongate body 52 and spaced 180° apart. As shown in FIG. 7, if the arrowhead 50 includes three blade elements 60, the apertures 62 are spaced 120° apart. As shown in FIG. 8, if the arrowhead 50 utilizes four blade elements 60, the apertures 62 will be spaced 90° apart.

Figure 9:
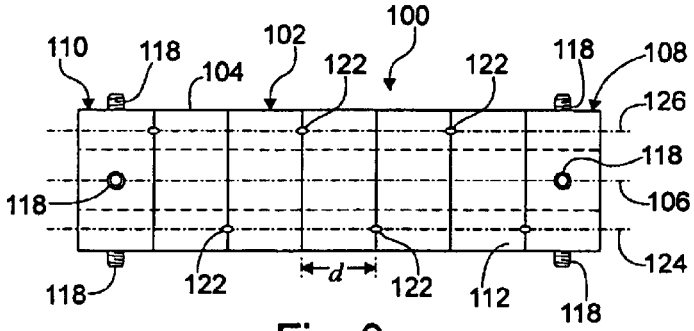
FIG. 9 is a front view of an apparatus for modifying an arrow for improved big game tracking according to the present invention.
Figure 10:
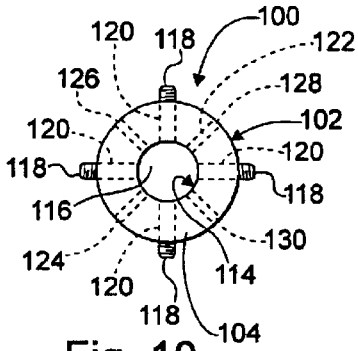
FIG. 10 is a right-end view of the apparatus shown in FIG. 9.
Figure 11:
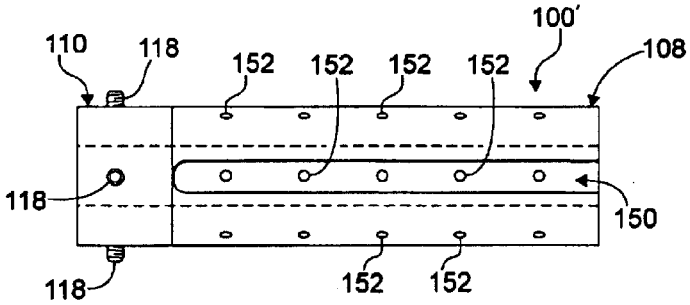
FIG. 11 is a front view of an additional embodiment of the apparatus for modifying an arrow for improved big game tracking according to the present invention.
Figure 12:
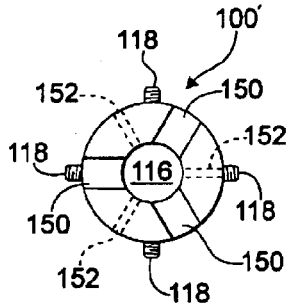
FIG. 12 is a right-end view of the apparatus shown in FIG. 11.

Referring to FIGS. 9–10 an apparatus for modifying an arrow for improved big game tracking according to the present invention is shown generally at 100. The apparatus 100 includes a jig member 102 having a body portion 104 preferably made of solid plastic. The body portion 104 is formed along a longitudinal axis 106 and has spaced first 108 and second 110 ends. The body portion 104 further includes an outer surface 112, preferably cylindrical in shape, and an inner surface 114 defining a first aperture 116 extending through the body portion 104 along the longitudinal axis 106. The first aperture 116 is sized to receive a shaft of an arrow. A plurality of securing members, or set screws, 118 are disposed generally approximate the first 108 and second 110 ends. Preferably, four set screws 118 are equally angularly spaced about the longitudinal axis 106 at each of the first 108 and second 110 ends, and are threaded into correspondingly threaded apertures 120 formed in the body portion 104. The set screws 118 are utilized to not only releaseably secure the jig member 100 to an arrow, but also to center the arrow within the first aperture 116. In order to accommodate arrow of varying sizes, the first aperture 116 typically has a 3/8" diameter, however, other size diameters may be utilized without departing from the spirit and scope of the present invention.

A plurality of apertures 122 are formed in the body portion 104 and extend from the outer surface 112 to the inner surface 114. Preferably, the apertures 122 extend radially with respect to the longitudinal axis 106. As shown in FIG. 9, the plurality of apertures 122 includes a first portion of apertures extending axially along a first line 124 substantially parallel with the longitudinal axis 106 and a second portion of apertures extending along a second line 126 substantially parallel with the longitudinal axis 106. As shown in FIG. 10, four such portions of apertures are provided in the apparatus 100, with the additional portions of apertures provided along lines 128 and 130, also substantially parallel with the longitudinal axis 106. As shown in FIG. 10, each of the four portions of apertures are equally angularly spaced about the longitudinal axis 106.

When four such portions of apertures are utilized, it is preferred that apertures in adjacent portions be axially spaced from one another a distance "d" as shown in FIG. 9. Thus, apertures formed along the line 124 will be coaxial with the apertures formed along line the 128, but axially spaced a distance "d" from the apertures formed along the lines 126 and 130. Similarly, the apertures formed along the line 126 will be coaxial with the apertures formed along the line 130, but axially spaced a distance "d" from the apertures formed along the lines 124 and 128. The apertures 122 may have a diameter ranging from 1/32" to 5/32", and preferably have a diameter of 1/16". Preferably, the distance "d" ranges from 0.5" to 1.0". However, other aperture diameters and axial distances may be utilized without departing from the spirit and scope of the present invention.

The apparatus 100 may be utilized to modified an arrow for improved big game tracking as follows. A shaft of an arrow is extended through the first aperture 116 and is releasably secured to the apparatus 100 via the set, screws 118. Preferably, the apparatus 100 is secured to the arrow shaft generally approximate the end configured for attachment to an arrowhead. A drill bit sized to fit through the apertures 122 is extended through the apertures 122 and ultimately through the arrow shaft forming a hole in the arrow shaft in fluid communication with the arrow shaft cavity. A user continues this process until holes are formed in the arrow shaft corresponding to each of the apertures 122 in the apparatus 100. The arrow that results from such modification has a plurality of the apertures formed in the shaft corresponding to the placement of apertures 122 on the apparatus 100.

Similarly, the apparatus 100 may be moved along the arrow shaft to a position away from the end configured for attachment to an arrowhead, and appropriate apertures may be formed in the arrow shaft at this location in the same manner as previously described. While FIGS. 9–10 illustrate an apparatus 100 having four equally angularly spaced portions of axially extending apertures two, three, five, etc. portions of equally angularly spaced apertures may be utilized without departing from the spirit and scope of the present invention. Additionally, while the various portions of axially spaced apertures have been described herein as equally angularly spaced, such equal angular displacement is not necessary to practice the present invention.

In order to provide additional apertures along the portion of the arrow shaft where the fletching 24 is attached, as shown in FIG. 1, the apparatus 100 requires modification in shown in FIGS. 11–14. The modified apparatus 100' has a plurality of longitudinal slots 150 formed in the body portion 104 between the inner 114 and outer 112 surfaces. Each of the longitudinal slots 150 has an open end at the first end 108 of the body portion 104 and extends longitudinally along the body portion. Radially extending apertures 152, similar to the apertures 122, are formed in the body portion 104 at areas of the body portion 104 between the longitudinal slots 150. As shown in FIGS. 11–14, the set screws 118 at the first end 108 are removed, such that securing the apparatus 100' to the arrow shaft is accomplished via the set screws 118 at the second end 110 only.

Figure 13:
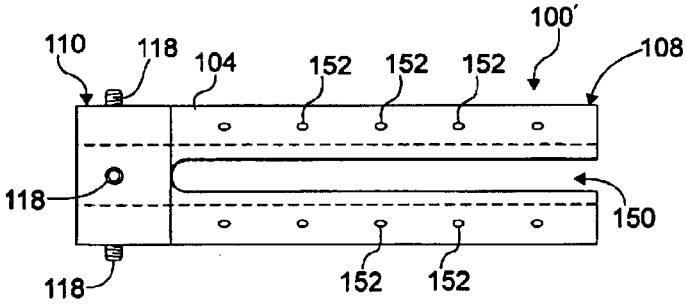
FIG. 13 is a front view of a further embodiment of the apparatus for modifying an arrow for improved big game tracking according to the present invention.
Figure 14:
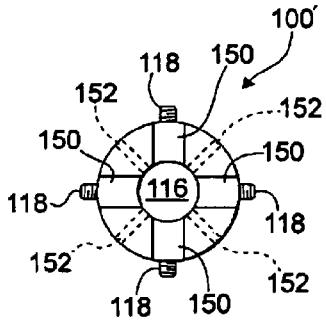
FIG. 14 is a right-end view of the apparatus shown in FIG. 13.

The apparatus 100' may be utilized to modify an arrow for improved big game tracking as follows The arrow shaft is received in the first aperture 116 and the apparatus 100' is slid along the arrow shaft until it reaches the portion where the fletching 24 is attached to the arrow shaft. The slots 150 are aligned with the fletching 24 and the apparatus 100' is further slid along the arrow shaft so that the fletching 24 is received within the longitudinal slots 150. The apparatus 100' is secured to the arrow via the set screws 118 at the second end 110. A user may extend a drill bit through the apertures 152 to drill holes in the arrow shaft at an area between the fletchings 24, as shown in FIG. 1. The apparatus 100' may include three (FIGS. 11–12) or four (FIGS. 13–14) equally angularly displaced longitudinal slots 150, depending upon the number of fletchings 24 utilized on a particular arrow. When utilizing four longitudinal slots 150 as shown in FIGS. 13–14, four portions of apertures 152 will be formed along the body portion 104 in the areas between the longitudinal slots 150. As previously noted, in order to maintain the structural integrity of the arrow, it is preferred that apertures in adjacent line portions be actually spaced from one another by a distance "d".

Referring to FIGS. 15–23, an apparatus for modifying an arrowhead for improved big game tracking according to the present invention is shown generally at 200. The apparatus 200 includes jig member 202 having a body portion 204, preferably made of solid plastic, with spaced first 206 and second 208 ends. The body portion 204 has a generally cylindrical outer surface. The apparatus 200 further includes a step bore 210 extending into the body portion 204 and having a central axis 212. The step bore 210 includes an innermost bore 214, a middle bore 216 and an outermost bore 218 opening at the first end 206. The innermost bore 214 is threaded and has a first diameter. The outermost bore 218 has a second diameter greater than the first diameter. The middle bore 216 has a third diameter which is smaller than the second diameter but greater than the first diameter. A longitudinal aperture 220 is formed in the body portion 204 extending along the central axis 212 and having openings at the innermost bore 214 and the second end 208.

Apertures 222 extend through the body portion 204 from the outer surface and open into the step bore 210 at the outermost bore 218. The apertures 222 preferably extend radially through the body portion 204 with respect to the central axis 212. However, a variety of aperture 222 configurations are contemplated and may be utilized without departing from the spirit and scope of the present invention.

Figure 16:
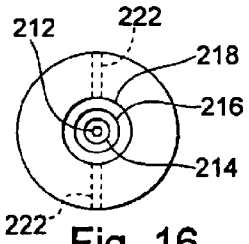
FIG. 16 is a left-end view of the apparatus shown in FIG. 15.
Figure 15:
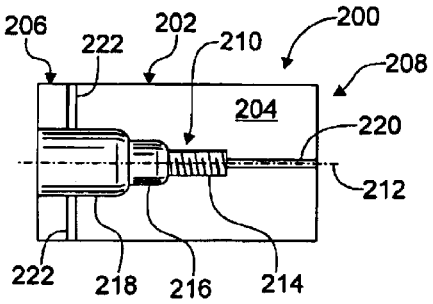
FIG. 15 is a front view of an apparatus for modifying an arrowhead for improved big game tracking according to the present invention.
Figure 17:
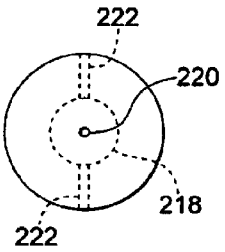
FIG. 17 is a right-end view of the apparatus shown in FIG. 15.
Figure 19:
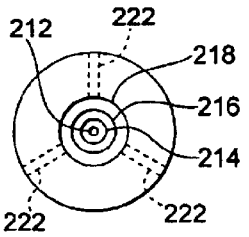
FIG. 19 is a left-end view of the apparatus shown in FIG. 18.
Figure 18:
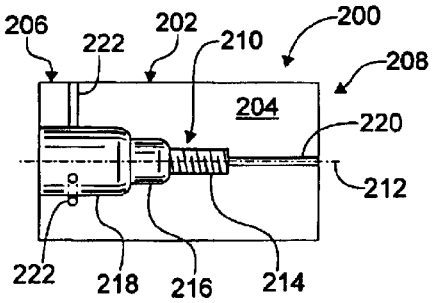
FIG. 18 is a front view of an additional embodiment of an apparatus for modifying an arrowhead for improved big game tracking according to the present invention.
Figure 20:
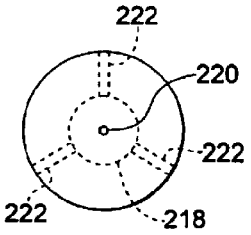
FIG. 20 is a right-end view of the apparatus shown in FIG. 18.
Figure 22:
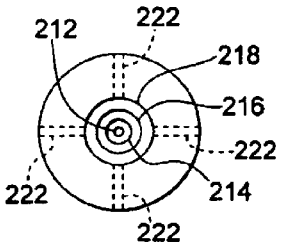
FIG. 22 is a left-end view of the apparatus shown in FIG. 21.
Figure 21:
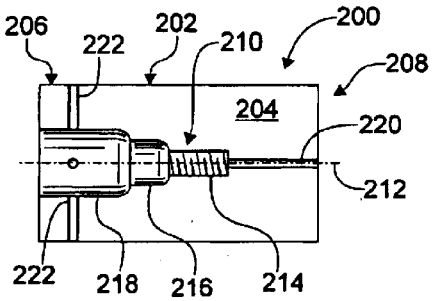
FIG. 21 is a front view of a further embodiment of the apparatus for modifying an arrowhead for improved game tracking according to the present invention.
Figure 23:
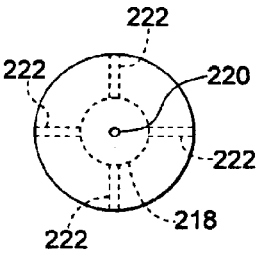
FIG. 23 is a right-end view of the apparatus shown in FIG. 21.

As shown in FIGS. 15–17, the apparatus 200 may include two radially extending apertures 222 formed in opposite sides of the body portion 204 and spaced 180° apart. As shown in FIGS. 18–20, the apparatus 200 may include three radially extending apertures 222 formed in the body portion 204 and equally angularly spaced 120° apart. As shown in FIGS. 21–23, the apparatus 200 may include four radially extending apertures 222 are formed in the body portion 204 and equally angularly spaced 90° apart. It should be understood, however, that any number of radially extending apertures 222 may be utilized without departing from the spirit and scope of the present invention.

The apparatus 200 is typically utilized to modify an arrowhead as follows. Arrowheads typically include a pointed end and a threaded end distal the pointed end. The threaded end of the arrowhead is received in the step bore 210 and threaded onto the threads in the innermost bore 214 to secure the arrowhead within the jig member 202. The arrowhead is rotated until the apertures in the body portion 204 are aligned such that they are between the sections of the arrowhead where the blade elements are positioned. The user can extend a drill bit through the aperture 222 to drill a hole in the arrowhead body. Similarly, a drill bit is extended through the longitudinal aperture 220 to drill a longitudinal hole in the distal threaded end of the arrowhead Once all apertures 222 and 220 have been utilized to drill holes in the arrowhead, the arrowhead can be removed and utilized with the arrow 10 shown in FIGS. 1 and 2 to provide an individual with improved big game tracking capabilities.

Typically, the number of blade elements utilized on a particular arrowhead will dictate the number of apertures 222 to be formed in the body portion 204. For example, an arrowhead which utilizes two blade elements disposed 180° apart could be modified utilizing the apparatus 200 shown in FIGS. 15–17. The arrowhead would be inserted in the step bore 210 and rotated until the two apertures 222, which are spaced 180° apart, are aligned with the body portion 204 of the arrowhead between the sections where the blades are attached. Appropriate holes would then be drilled in the arrowhead utilizing the apertures 220 and 222 as guides.

For arrowheads utilizing three blade elements equally angularly displaced about the arrowhead, the apparatus 200 shown in FIGS. 18–20 could be utilized to modify the arrowhead. The arrowhead would be received in the step bore 210 and rotated until the three apertures 222, which are spaced 120° apart, are aligned with the body portion 204 between the sections of the arrowhead where the blade elements are attached. Appropriate holes would then be drilled through the arrowhead utilizing the apertures 220 and 222 as guides.

For arrowheads with four blade elements equally angularly displaced about the arrowhead, the apparatus 200 shown in FIGS. 21–23 could be utilized to modify the arrowhead. The arrowhead would be received in the step bore 210 and rotated until the four apertures 222, which are spaced 90° apart, are aligned with the body portion 204 of the arrowhead between the sections where the blade elements are positioned. Appropriate holes would then be drilled in the arrowhead using the apertures 220 and 222 as guides. The apparatus 200 shown in FIGS. 21–23 could also be utilized with arrowheads having two blade elements by utilizing only one pair of oppositely displaced apertures 222 to drill appropriate holes in the arrowhead.

Typically, arrowheads do not incorporate more than four blade elements. However, if an arrowhead utilizes more than four blade elements, the apparatus 200 shown in FIGS. 15–23 could be incorporated with five equally angularly displaced apertures 222 without departing from the spirit and scope of the present invention. While the apertures 220 and 222 are preferably 1/16" in diameter, other aperture diameters may be utilized without departing from the spirit and scope of the present invention.

While the present invention has been described with particular reference to the drawings, it should be understood that various modifications could be made without departing from the spirit and scope of the present invention.

I claim:

1. An apparatus for modifying an arrow for improved big game tracking, said apparatus comprising:

a jig member including a body portion having spaced first and second ends and a longitudinal axis, the body portion further having an outer surface and an inner surface defining a first aperture extending through the body portion along the longitudinal axis, the first aperture sized to receive a shaft of an arrow, wherein the body portion includes at least one second aperture extending through the body portion from the inner surface to the outer surface, wherein the at least one second aperture comprises a plurality of radially extending apertures, and wherein the plurality of radially extending apertures includes a first portion of radially extending apertures axially spaced along the longitudinal axis.

2. The apparatus of claim 1, wherein the plurality of radially extending apertures comprises two, three or four radially extending apertures equally angularly spaced about the longitudinal axis.

3. The apparatus of claim 1, wherein the plurality of radially extending apertures includes a second portion of radially extending apertures axially spaced along the longitudinal axis.

4. The apparatus of claim 3, wherein the first and second portions of radially extending apertures are coaxial.

5. The apparatus of claim 3, wherein each of the first portion of radially extending apertures is axially and angularly spaced from each of the second portion of radially extending apertures.

6. An apparatus for modifying an arrow for improved big game tracking, said apparatus comprising:

a jig member including a body portion having spaced first and second ends and a longitudinal axis, the body portion further having an outer surface and an inner surface defining a first aperture extending through the body portion along the longitudinal axis, the first aperture sized to receive a shaft of an arrow, wherein the body portion includes at least one second aperture extending through the body portion from the inner surface to the outer surface, wherein the jig member includes a plurality of longitudinal slots formed in the body portion between the inner and outer surfaces, the plurality of longitudinal slots having an open end at the body portion first end and extending generally longitudinally along the body portion.

7. The apparatus of claim 6, wherein the plurality of longitudinal slots are equally angularly spaced about the longitudinal axis.

8. An apparatus for modifying an arrowhead for improved big game tracking, said apparatus comprising:

a jig member including a body portion having spaced first and second ends and a step bore extending into the body portion and having a central axis, the step bore having an innermost bore having a first diameter and an outermost bore opening at the first end and having a second diameter greater than the first diameter, wherein the jig member includes at least one aperture extending through the body portion and opening into the step bore at the outermost bore, wherein the at least one aperture includes a plurality of radially extending apertures equally angularly spaced about the central axis.

9. An apparatus for modifying an arrowhead for improved big game tracking, said apparatus comprising:

a jig member including a body portion having spaced first and second ends and a step bore extending into the body portion and having a central axis, the step bore having an innermost bore having a first diameter and an outermost bore opening at the first end and having a second diameter greater than the first diameter, wherein the jig member includes at least one aperture extending through the body portion and opening into the step bore at the outermost bore, wherein the innermost bore comprises a threaded bore.

10. The apparatus of claim 6, wherein the at least one second aperture comprises a radially extending aperture.

11. The apparatus claim 10, wherein the at least one radially extending second aperture has a diameter ranging from 1/32" to 5/32".

12. The apparatus of claim 10, wherein the at least one radially extending second aperture comprises a plurality of radially extending apertures.

13. The apparatus of claim 12, wherein the plurality of radially extending apertures comprises two, three or four radially extending apertures equally angularly spaced about the longitudinal axis.

14. The apparatus of claim 6, wherein the outer surface of the body portion comprises a cylindrically shaped outer surface.

15. The apparatus of claim 6, wherein the jig member further includes a securing member disposed generally proximate at least one of the first and second ends, the securing member configured to engage an arrow shaft extending through the first aperture to releasably secure the jig member to the arrow shaft.

16. The apparatus of claim 1, wherein the plurality of radially extending apertures have diameters ranging from 1/32" to 5/32".

17. The apparatus of claim 1, wherein the outer surface of the body portion comprises a cylindrically shaped outer surface.

18. The apparatus of claim 1, wherein the jig member further includes a securing member disposed generally proximate at least one of the first and second ends, the securing member configured to engage an arrow shaft extending through the first aperture to releasably secure the jig member to the arrow shaft.

19. The apparatus of claim 18, wherein the securing member includes at least one set screw extendable through at least one radially extending threaded aperture provided through the body portion from the inner to the outer surfaces.

20. The apparatus of claim 15, wherein the securing member includes at least one set screw extendable through at least one radially extending threaded aperture provided through the body portion from the inner to the outer surfaces.

* * * * *